US008662345B1

(12) United States Patent
Wang

(10) Patent No.: US 8,662,345 B1
(45) Date of Patent: Mar. 4, 2014

(54) COLLAPSIBLE FRONTWARD-TILTING RECEPTACLE DEVICE

(71) Applicant: Wen-Tsan Wang, Taipei (TW)

(72) Inventor: Wen-Tsan Wang, Taipei (TW)

( * ) Notice: Subject to any disclaimer, the term of this patent is extended or adjusted under 35 U.S.C. 154(b) by 0 days.

(21) Appl. No.: 13/624,975

(22) Filed: Sep. 24, 2012

(51) Int. Cl.
*B65D 43/14* (2006.01)
*B65F 1/16* (2006.01)

(52) U.S. Cl.
CPC .. *B65F 1/16* (2013.01); *B65D 43/14* (2013.01)
USPC ..... 220/825; 220/666; 220/23.86; 220/7

(58) Field of Classification Search
USPC ..... 220/666, 6, 7, 4.01, 23.86, 23.83, 220/23.87, 810, 825; 229/123
See application file for complete search history.

(56) References Cited

U.S. PATENT DOCUMENTS 3,944,128 A * 3/1976 Hogan ..... 229/221
4,317,536 A * 3/1982 Dickerson ..... 229/121
5,642,837 A * 7/1997 Hayes et al. ..... 221/197
6,345,758 B2 * 2/2002 Jaggi ..... 229/123
6,923,365 B2 * 8/2005 Auclair et al. ..... 229/120.011
7,204,406 B2 * 4/2007 Bone ..... 229/242
7,703,665 B2 * 4/2010 McGowan ..... 229/122.1
8,413,879 B2 * 4/2013 Bevier ..... 229/122

* cited by examiner

*Primary Examiner* — Robert J Hicks
*Assistant Examiner* — Kareen Rush
(74) *Attorney, Agent, or Firm* — Leong C. Lei

(57) ABSTRACT

A collapsible frontward-tilting receptacle device includes a stationary receiving body that defines an internal space and is collapsible and a movable receiving body that forms a receiving space. The stationary receiving body has a bottom on which a rigid movable bottom board is positioned. The stationary receiving body has a side wall to which a movable support board having a stop section is movably connected. A free end of the movable support board is connected to an opposite side wall of the stationary receiving body to serve as a top plate. The movable receiving body is received in the internal space of the stationary receiving body so that a front end of the bottom thereof is coupled to a front portion of the bottom of the stationary receiving body to allow a top opening of the movable receiving body to be rotated out of the stationary receiving body.

3 Claims, 9 Drawing Sheets

COLLAPSIBLE FRONTWARD-TILTING RECEPTACLE DEVICE

TECHNICAL FIELD OF THE INVENTION

The present invention generally relates to a frontward-tilting receptacle device for deposition of clothing.

DESCRIPTION OF THE PRIOR ART

Dirty clothes to be cleaned are often placed in a receptacle basket that is generally a fixed container made of any available material, such as plastics, bamboo, and fabrics. Such a container is often provided with an opening in a top thereof to allow a user to deposit clothes through the opening into the container or to remove clothes to be washed via the opening. Consequently, the conventional laundry basket allows other people to view the dirty clothes inside the basket and the opening that is formed in the top makes it inconvenient for a user to remove clothes for the clothes must be picked up exactly in the vertical direction.

Further, in order to allow the volume to be reduced for easy storage, some of the laundry baskets are made in a collapsible form. For example, some of the laundry baskets are made of flexible fabric in the form of a rectangular box, of which four top edges, four vertical edges, and four bottom edges are each provided with a bar, whereby the flexible box body can be expanded and supported by the bars to serve as a receptacle for dirty laundries. And, such a box can be collapsed to a flat form. However, the conventional laundry basket generally comprises a large number of parts and has a complicated structure so that the operation is difficult and inconvenient and the manufacture cost is high.

SUMMARY OF THE INVENTION

The primary object of the present invention is to provide a receptacle device that has a receiving body having a opening that is selectively tilted frontward to allow easy access of clothes therein, allows the opening of the receiving body to be concealed when no access is to be made to the received clothes, and allows the receiving body to be collapsed to a small volume for easy storage when not in use.

The feature of the present invention comprises a stationary receiving body forming an internal space and a movable receiving body forming a receiving space. The movable receiving body is received in the internal space of the stationary receiving body. The movable receiving body has a bottom having a front portion that is connected to a front portion of a bottom of the stationary receiving body in order to allow a user to pull the movable receiving body to rotate out of the stationary receiving body for exposing a top opening of the receiving space. A stop section mounted to the movable support board of the stationary receiving body limits the frontward tilting angle of the movable receiving body for easy deposition and removal of clothes therein. When it is not desired to remove or deposit clothes, the movable receiving body can be rotated into the stationary receiving body to conceal the receiving space, making the outside appearance of the entire receptacle device beautiful.

The stationary receiving body and the movable receiving body of the present invention can be collapsed to a flat form when not in use for easy storage.

The technical solution of the present invention comprises a stationary receiving body and a movable receiving body that are collapsible, wherein the stationary receiving body comprises a rectangular body forming an internal space. The stationary receiving body has a front side forming an opening communicating with the internal space. The internal space has a bottom on which a rigid movable bottom board is positioned to expand and fix the stationary receiving body. The movable bottom board comprises a fastening element mounted to a front portion of a top surface thereof. The stationary receiving body comprises a movable support board that has a stop section extending therefrom movably connected to an inside surface of a side wall thereof close to a top. An opposite end of the movable support board forms an extension section that is bent in an opposite manner. The stationary receiving body forms in an opposite side thereof a through slot that receives the extension section to extend therethrough. By having the extension section extending through the through slot, the movable support board is retained in position to serve as a top board of the stationary receiving body. The movable receiving body forms a receiving space having an opening facing upward. The movable receiving body comprises a fastening band mounted to a front portion of a bottom thereof. By positioning the movable receiving body in the internal space of the stationary receiving body, the fastening band and the fastening element engage and are coupled to each other to allow the movable receiving body to rotate with respect to the stationary receiving body with the fastening band serving as a connection element, so that the movable receiving body can be tilted frontward to project out of the stationary receiving body or the movable receiving body can be retracted back into the stationary receiving body. When the movable receiving body is tilted frontward to project out of the stationary receiving body, the stop section engages and stops a circumference of the opening of the movable receiving body to limit a frontward tilting angle.

The present invention may alternatively makes the contours of opposite side walls of the movable receiving body in a sloped form in order to expand the opening of the movable receiving body and may additionally provide a receptacle basket that is receivable in the movable receiving body to collect clothes therein for collective removal of the clothes.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
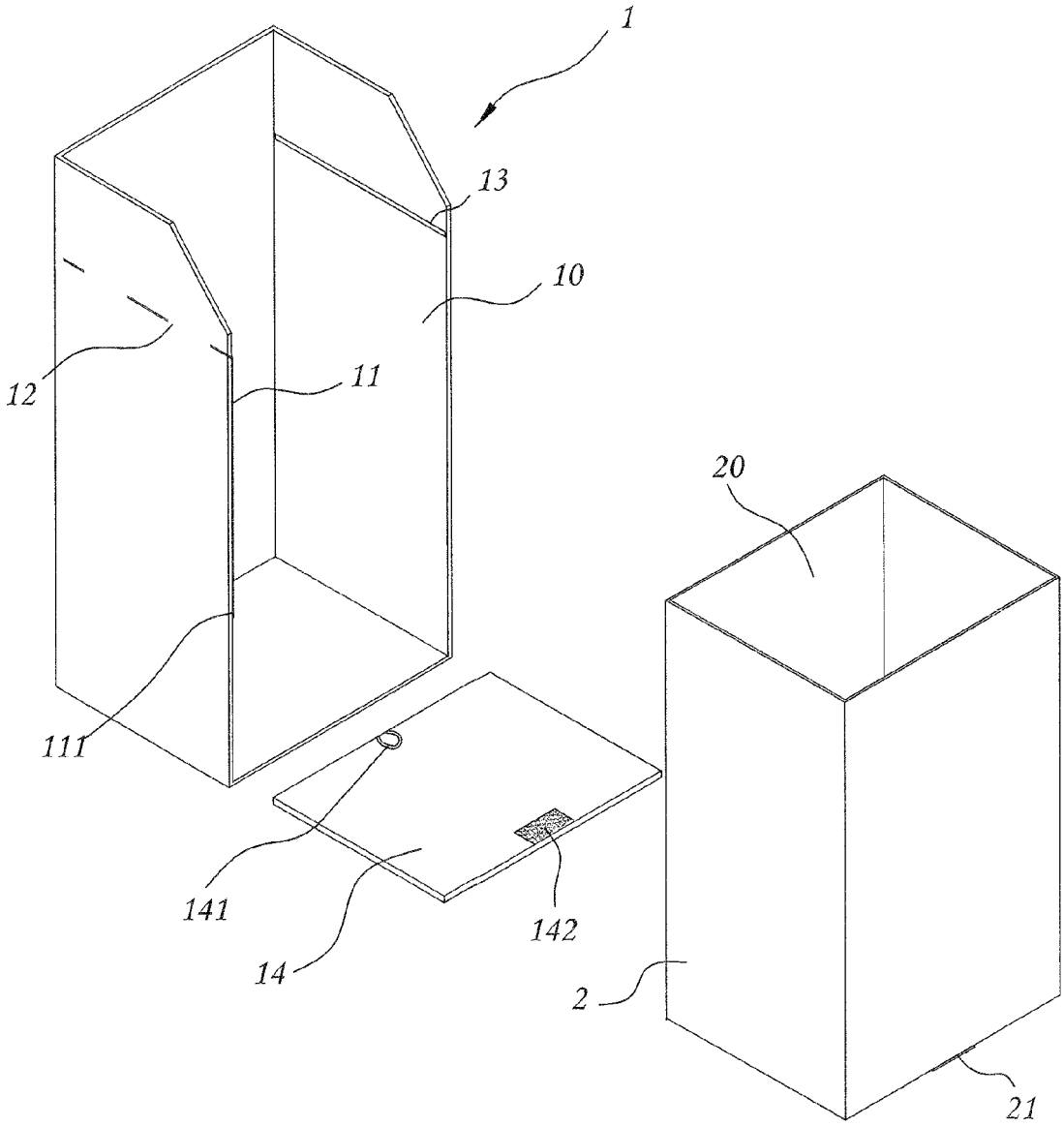
FIG. 1 is an exploded view showing spatial relationship among components of a receptacle device according to an embodiment of the present invention.
Figure 2:
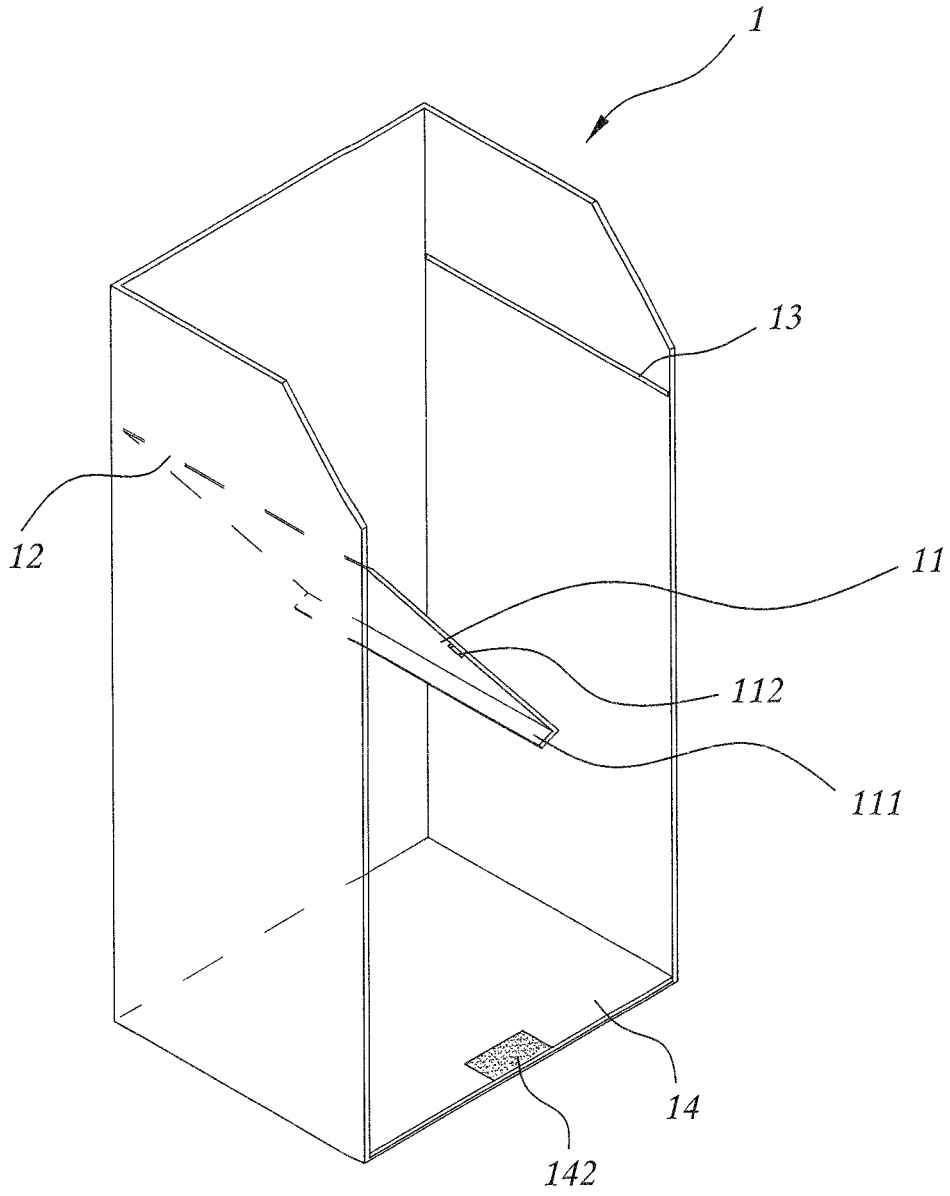
FIG. 2 is a perspective view showing a back board erected in a stationary receiving body and a movable support board is lifted.
Figure 3:
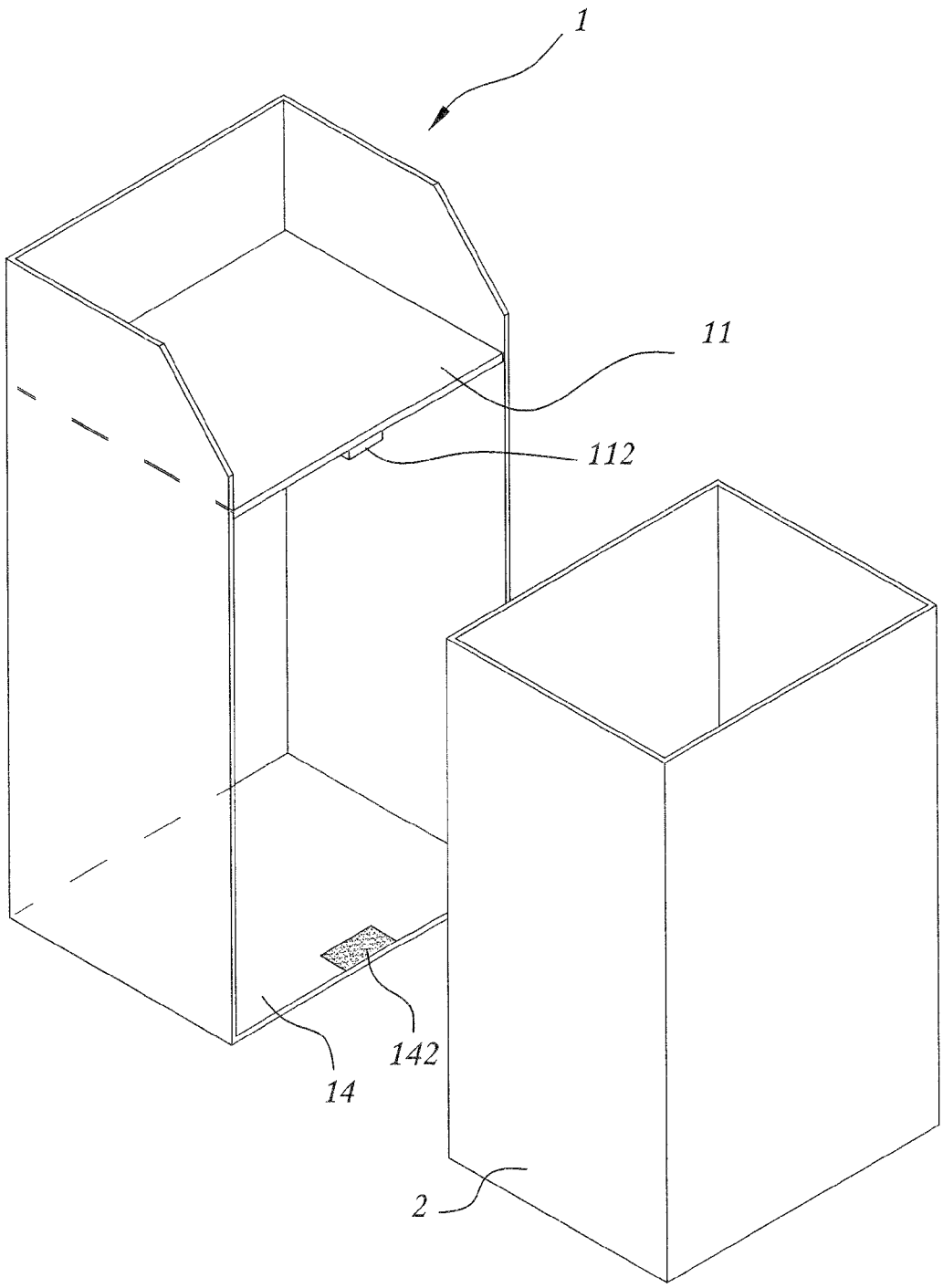
FIG. 3 is a perspective view showing the movable support board assembled and fixed in the stationary receiving body to receive the movable receiving body therein.
Figure 9:
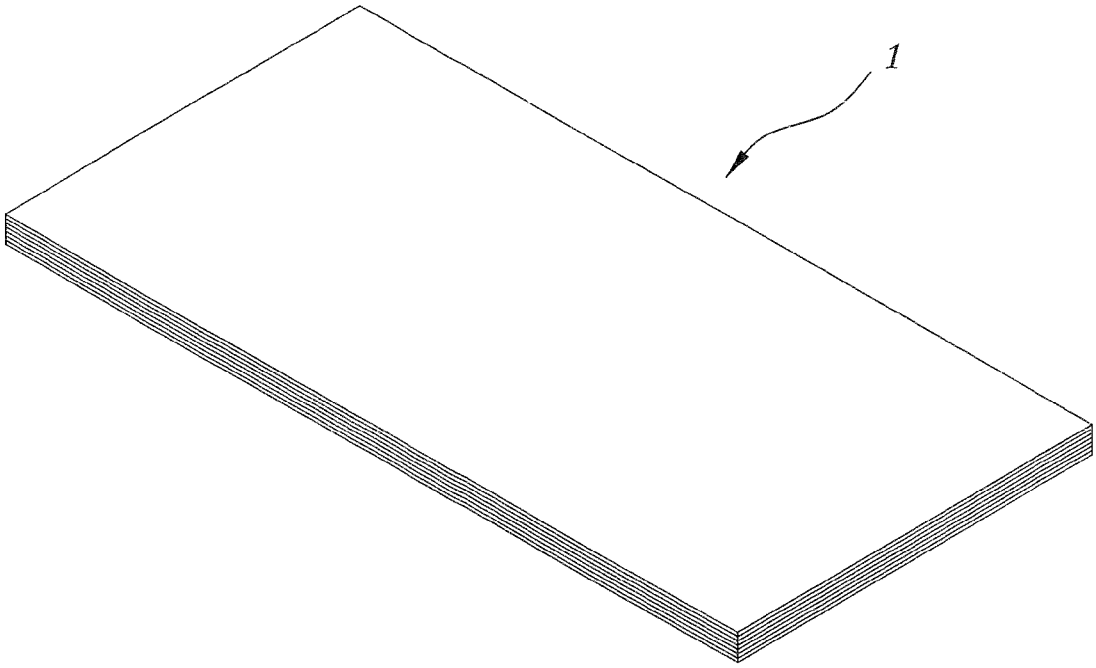
FIG. 9 is a perspective view showing the stationary receiving body collapsed to a flat form.

As shown in FIG. 1, the present invention provides a collapsible frontward-tilting receptacle device, of which a preferred embodiment comprises a stationary receiving body 1 and a movable receiving body 2. The stationary receiving body 1 is collapsible to a flat form for easy storage when not in use (see FIG. 9). As shown in FIG. 1, the stationary receiving body 1, after being expanded and assembled, forms a rectangular body that defines an internal space 10 and forms in a front side thereof an opening communicating with the internal space 10. The present invention comprises a movable bottom board 14, which is made of a rigid material, disposed on a bottom of the stationary receiving body 1. The movable bottom board 14 has a shape and area that substantially correspond to the bottom area of the stationary receiving body 1, whereby by placing the movable bottom board 14 on the bottom of the stationary receiving body 1, the stationary receiving body 1 is expanded and held. The movable bottom board 14 is provided, at a rear portion thereof; with a pull ring 141, whereby when the device is not in use, the pull ring can be pulled to remove the movable bottom board 14 from the stationary receiving body 1. The movable bottom board 14 is provided, at a front portion of an upper surface thereof; with a fastening element 142. Inside the stationary receiving body 1, a movable connection fringe 12 is mounted at one side thereof close to a top, through sewing, in order to connect a movable support board 11 in a movable manner. An edge of the movable support board 11 is connected to an extension section 111 that is bent in an opposite manner. A stop section 112 is formed on a front portion of a bottom surface of the movable support board 11 and projects therefrom. Inside the stationary receiving body 1, a through slot 13 is formed through an opposite side to receive the extension of the extension section 111 therethrough, whereby a user may first lift up the movable support board 11 (as shown in FIG. 2) to a horizontal condition and then insert the extension section 111 into the through slot 13 to be retained thereby. The movable support board 11 may serve as a component for horizontal support of the stationary receiving body 11 and also serve as a top of the stationary receiving body 1 (see FIG. 3).

Figure 4:
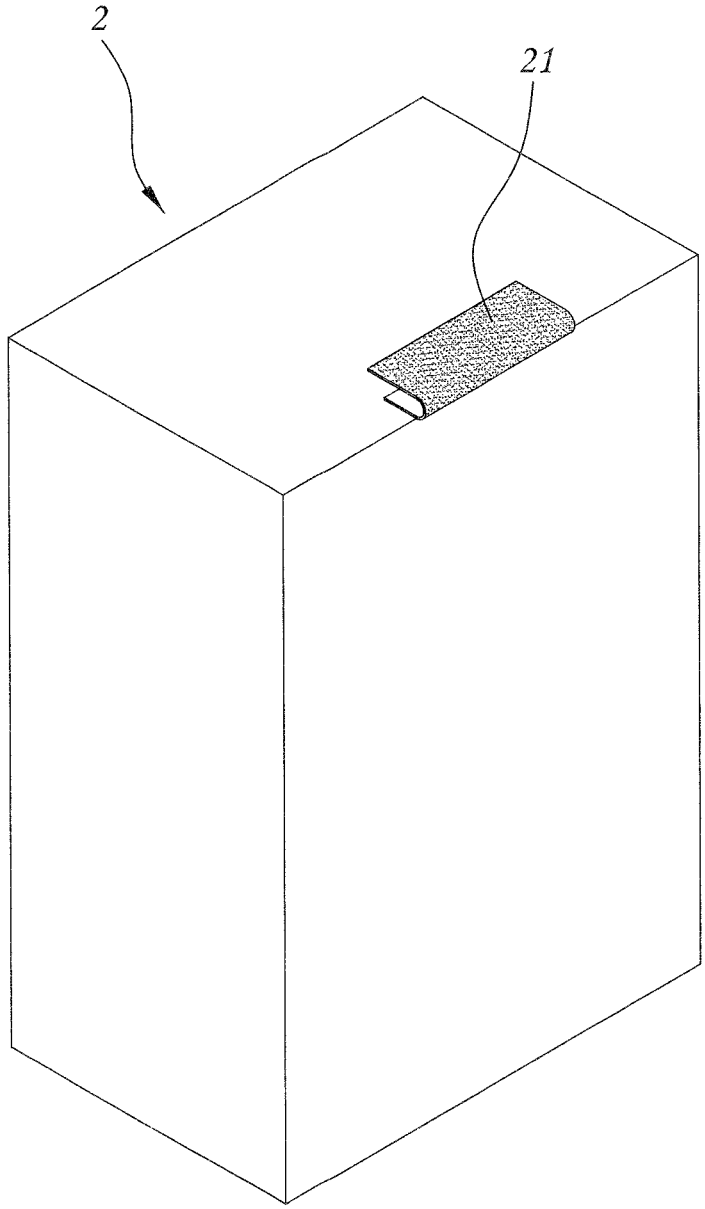
FIG. 4 is a perspective view showing the movable receiving body according to the present invention.
Figure 5:
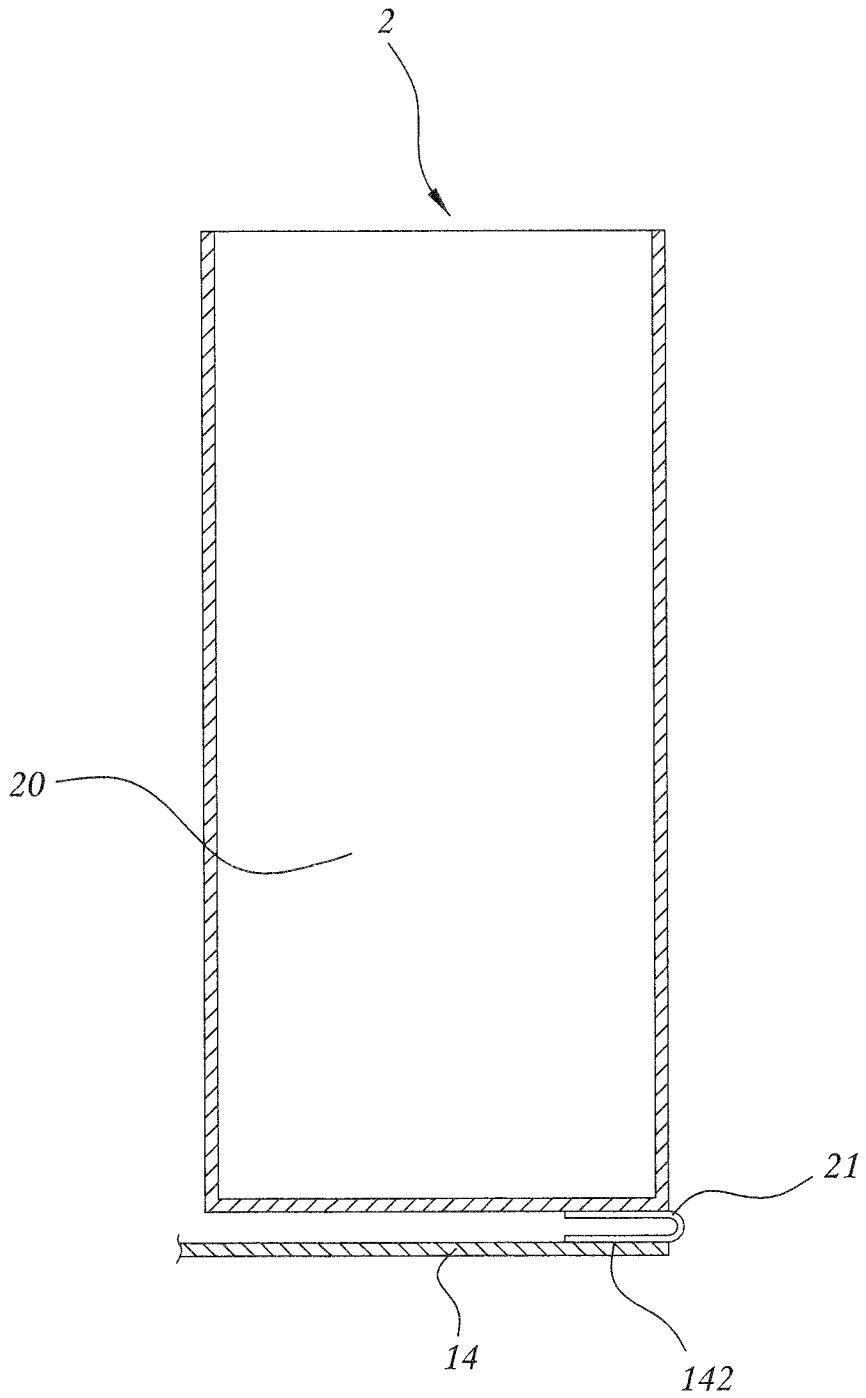
FIG. 5 is a partial cross-sectional view showing the movable receiving body received in the stationary receiving body according to the present invention.
Figure 6:
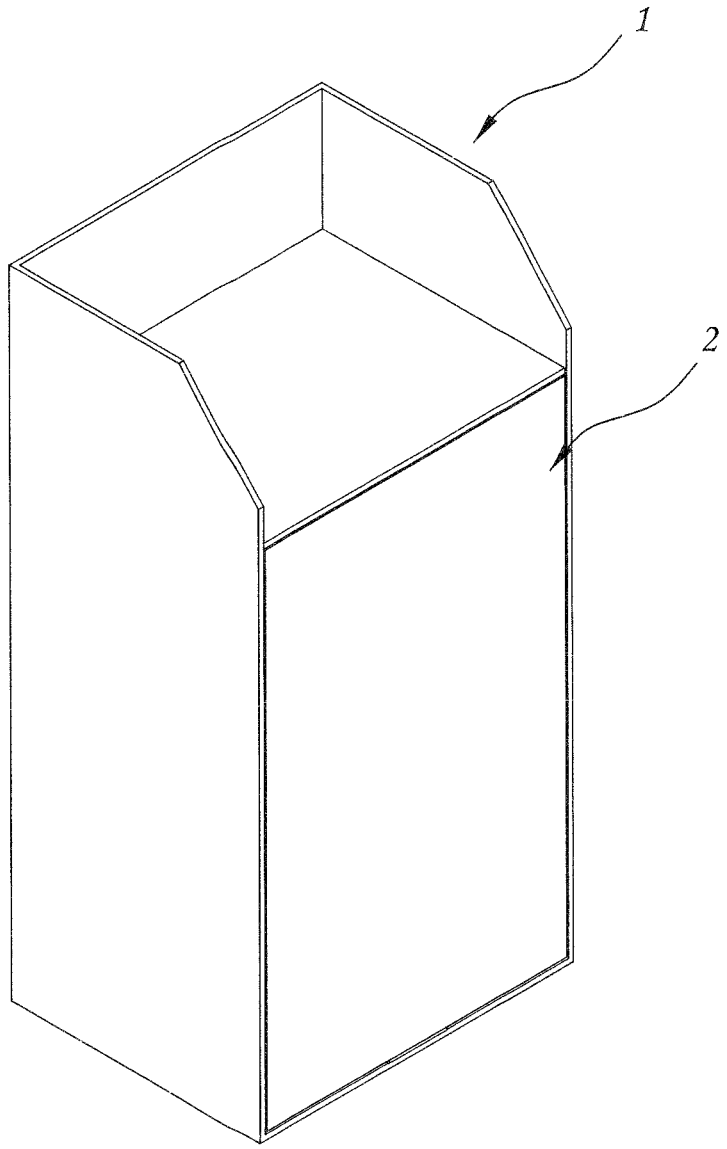
FIG. 6 is a perspective view showing the movable receiving body received in the stationary receiving body according to the present invention.

As shown in FIGS. 1 and 4, the movable receiving body 2 of the present invention forms a receiving space 20 having an opening that faces upward so that when not in use, collapse can be made to a flat form. The movable receiving body 2 comprises a fastening band 21 mounted to a front portion of a bottom thereof. The movable receiving body 2 is receivable in the internal space 10 of the stationary receiving body 1 in such a way that the fastening band 21 mounted to the movable receiving body 2 and the fastening element 142 engage and are thus coupled to each other. In the preferred embodiment, the fastening element 142 can be a hook-and-loop fastening strip and the fastening band 21 is a corresponding fastener, such as Velcro pad, that is engageable with and fastened to the hook-and-loop fastening strip. When the movable receiving body 2 is assembled in the stationary receiving body 1 and the fastening band 21 and the fastening element 142 are fastened together (as shown in FIG. 5), the movable receiving body 2 is retained in the stationary receiving body 1 (as shown in FIG. 6).

Figure 7:
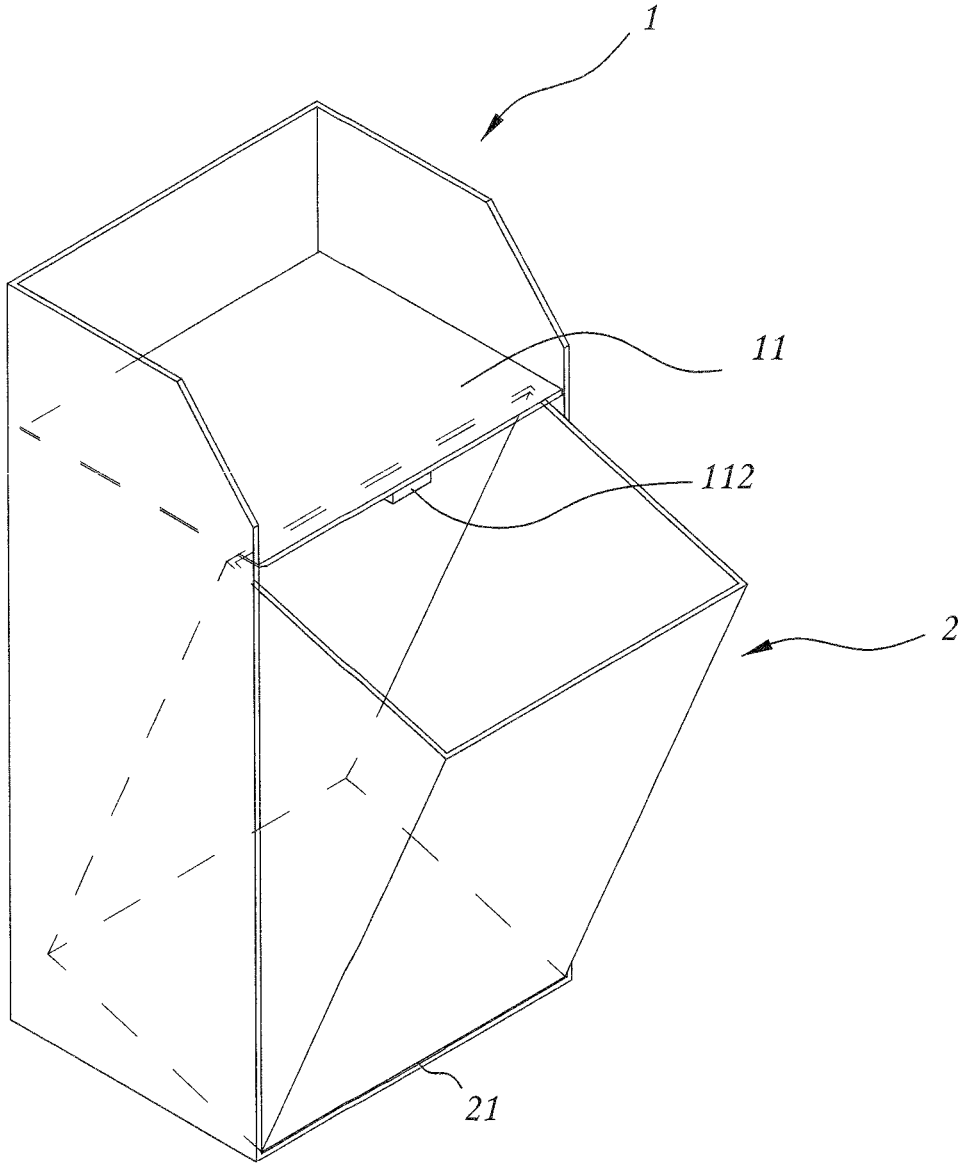
FIG. 7 is a perspective view the movable receiving body of the receptacle device of the present invention tilting frontward with respect to the stationary receiving body.

As shown in FIG. 7, with the above described receptacle device, a user, when intending to store clothes, pulls the upper portion of the movable receiving body 2 in an outward direction, whereby the movable receiving body 2 undergoes a rotational motion with respect to the stationary receiving body 1 about a rotation center defined by the connection of the fastening band 21 so as to make the top opening of the receiving space 20 tilting and protruding outside the stationary receiving body 1. The stop section 112 formed on and projecting from the bottom surface of the movable support board 11 provides a stop to a circumference of the opening of the movable receiving body 2 so as to limit the tilting angle of the movable receiving body 2, whereby the user may easily deposit clothes into the receiving space 20 to remove clothes out of the receiving space 20.

Figure 8:
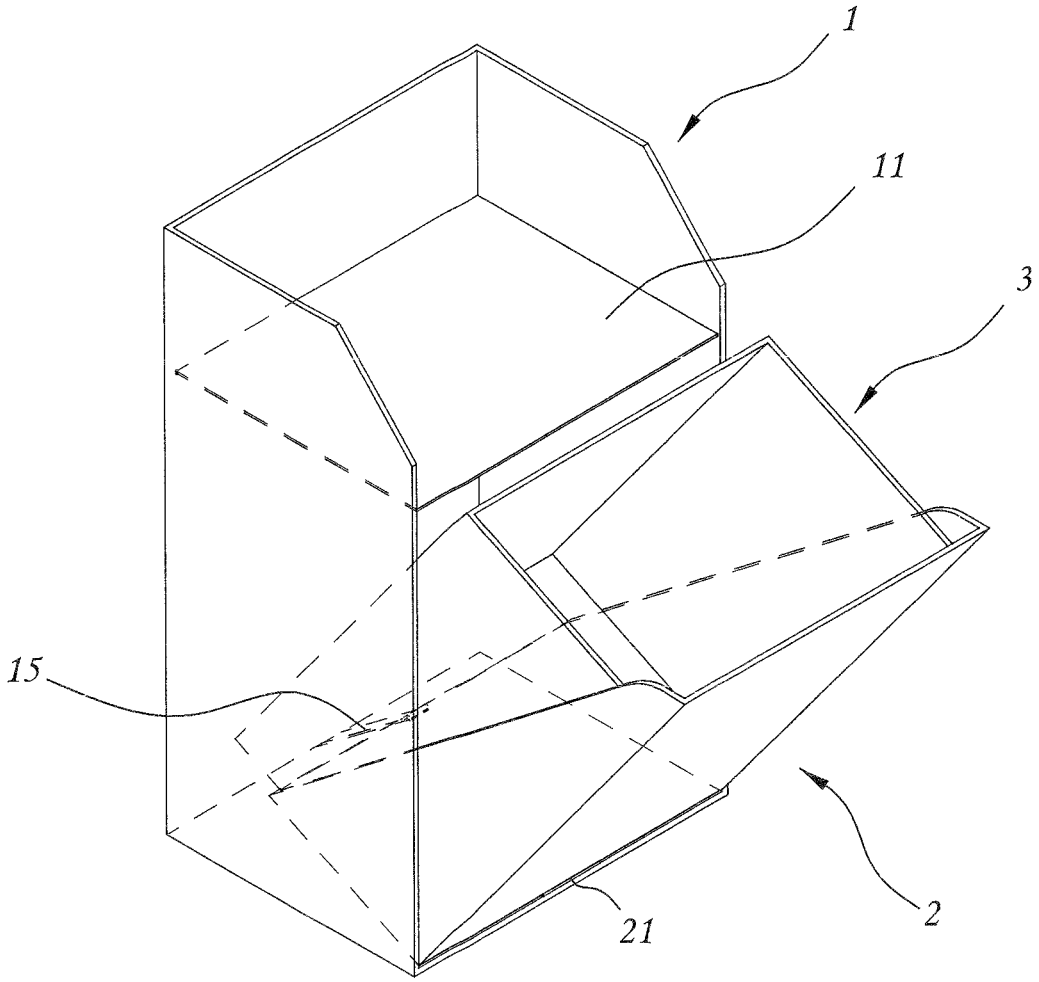
FIG. 8 is a perspective view showing another embodiment of the movable receiving body that uses a receptacle basket.

Besides the receiving space 20 of the movable receiving body 2 being used to receive clothes therein, a receptacle basket 3 (see FIG. 8) is additionally provided. The receptacle basket 3 is generally a container defining an internal space and is positionable in the receiving space 20 of the movable receiving body 2, so that a user may deposit clothes in the receptacle basket 3 to a certain extent. When it is desired to do laundry, the movable receiving body 2 is rotated and tilted to allow the receptacle basket 3 to be removed out of the movable receiving body 2. In this way, there is no need to pick up the clothes one by one from the movable receiving body 2. To allow the receptacle basket 3 to be easily deposited into or removed out of the movable receiving body 2, in the embodiment illustrated in FIG. 8, opposite side walls of the movable receiving body 2 are made in a slope form and a rear wall is removed, whereby the internal space of the receptacle basket 3 takes the place of the receiving space of the movable receiving body 2. Further, a connection element 15 is provided on an inside surface of the bottom of the stationary receiving body 1 and the connection element 15 is coupled to a rear portion of the bottom of the movable receiving body 2, whereby when the movable receiving body 2 is rotated out of the stationary receiving body 1, the connection element 15 holds the movable receiving body 2 in position in an inclined condition for easy access of clothes therein. The connection element 15 can be for example a hook-and-loop fastener.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A collapsible frontward-tilting receptacle device, comprising:

a stationary receiving body, which is a rectangular body that is collapsible and forms an internal space, the stationary receiving body having a front side forming an opening in communication with the internal space, the stationary receiving body comprising a movable support board received therein and connected, in a movable manner, to one side thereof close to a top, the movable support board comprising a stop section, the movable support board having an edge forming an extension section that is bent in an opposite manner, the stationary receiving body forming in an opposite side thereof a through slot that receives the extension section to extend therethrough, the stationary receiving body having a bottom on which a movable bottom board is positioned, the movable bottom board comprising a fastening element mounted to a front portion of an upper surface thereof;

a movable receiving body, which forms a receiving space, the movable receiving body having a fastening band mounted to a front portion of a bottom thereof to engage and couple to the fastening element, whereby the movable receiving body is rotatable with respect to the stationary receiving body via the fastening band so as to have a top opening of the receiving space tilting frontward to project outside the stationary receiving body or retracted into the stationary receiving body, wherein when the movable receiving body projects frontward outside the stationary receiving body, the stop section engages and stops a circumference of the opening of the receiving space to limit a frontward tilting angle.

2. The collapsible frontward-tilting receptacle device according to claim 1, wherein the fastening element comprises a hook-and-loop fastening strip and the fastening band comprises a pad that is engageable with and coupled to the hook-and-loop fastening strip.

3. The collapsible frontward-tilting receptacle device according to claim 1 further comprising a receptacle basket receivable and positionable in the receiving space of the movable receiving body, the movable receiving body having opposite side walls that are made in a sloped form.

* * * * *